US005803550A

United States Patent [19]

Watson et al.

[11] Patent Number: 5,803,550

[45] Date of Patent: Sep. 8, 1998

[54] METHOD FOR CONTROLLED FRAGMENTATION OF HARD ROCK AND CONCRETE BY THE COMBINATION USE OF IMPACT HAMMERS AND SMALL CHARGE BLASTING

[75] Inventors: John David Watson, Evergreen; Brian P. Micke, Golden, both of Colo.

[73] Assignee: Bolinas Technologies, Inc., Golden, Colo.

[21] Appl. No.: 689,317

[22] Filed: Aug. 7, 1996

Related U.S. Application Data

[60] Provisional application No. 60/001,956 Aug. 7, 1995.

[51] Int. Cl.[6] ..... E21C 3/04; E21C 37/14; F42D 3/04

[52] U.S. Cl. ..... 299/13; 299/37.3; 299/70

[58] Field of Search ..... 299/13, 29, 69, 299/70, 37.3, 37.4, 37.5

[56] References Cited

U.S. PATENT DOCUMENTS

| | | | |
|---|---|---|---|
| 1,189,011 | 6/1916 | Smith | 102/430 |
| 1,585,664 | 5/1926 | Gilman | 299/13 |
| 2,587,243 | 2/1952 | Sweetman | 102/307 |
| 2,799,488 | 7/1957 | Mandt | 299/13 |
| 3,055,648 | 9/1962 | Lawrence et al. | 299/13 X |
| 3,307,445 | 3/1967 | Stadler et al. | 102/313 X |
| 3,421,408 | 1/1969 | Badali et al. | 89/33.1 |
| 3,623,771 | 11/1971 | Sosnowicz et al. | 299/12 |
| 3,721,471 | 3/1973 | Bergmann et al. | 299/55 |
| 3,735,704 | 5/1973 | Livingston | 102/332 |
| 3,848,927 | 11/1974 | Livingston | 299/13 |
| 3,975,056 | 8/1976 | Peterson | 299/42 |
| 3,988,037 | 10/1976 | Denisart et al. | 299/16 |
| 4,040,355 | 8/1977 | Hopler, Jr. | 102/313 |
| 4,080,000 | 3/1978 | Pavrat | 299/70 X |
| 4,099,784 | 7/1978 | Cooper | 299/10 |
| 4,123,108 | 10/1978 | Lavon | 299/16 |
| 4,141,592 | 2/1979 | Lavon | 299/16 |
| 4,149,604 | 4/1979 | Lockwood et al. | 175/57 |
| 4,165,690 | 8/1979 | Abrahams | 102/314 |
| 4,195,885 | 4/1980 | Lavon | 299/1.4 |
| 4,204,175 | 5/1980 | Lavon | 299/16 |
| 4,289,275 | 9/1981 | Lavon | 299/17 X |
| 4,501,199 | 2/1985 | Mashimo et al. | 102/313 |
| 4,508,035 | 4/1985 | Mashimo et al. | 102/313 |
| 4,530,396 | 7/1985 | Mohaupt | 102/313 X |
| 4,582,147 | 4/1986 | Dardick | 175/1 |
| 4,655,082 | 4/1987 | Peterson | 299/1 X |
| 4,669,783 | 6/1987 | Kolle | 299/16 |
| 4,900,092 | 2/1990 | Van Der Westhuizen et al. | 299/13 |
| 5,098,163 | 3/1992 | Young, III | 299/13 |
| 5,308,149 | 5/1994 | Watson et al. | 299/13 |

FOREIGN PATENT DOCUMENTS

| | | | |
|---|---|---|---|
| 800883 | 9/1958 | United Kingdom | 299/16 |

OTHER PUBLICATIONS

Sunburst Recovery, Inc., "Controlled Fracture Techniques for Continuous Drill and Blast", NSF Report, Jul. 1984.

Bligh, "Principles of Breaking Rock Using High Pressure Gases", Advances in Rock Mechanics, Denver 1974.

Cooper et al., "A Novel Concept for a Rock–Breaking Machine . . . ", Institute Cerac S.A., Switzerland, 1980.

Dalley, et al., "Fracture Control in Construction Blasting", University of Maryland, 1977.

*Primary Examiner*—David J. Bagnell
*Attorney, Agent, or Firm*—Sheridan Ross P.C.

[57] ABSTRACT

The present invention is directed to a method for breaking rock and other hard materials using small-charge blasting techniques followed by a mechanical impact breaker. In small-charge blasting techniques, a gas is released into the bottom of a sealed hole located in a free surface of the hard material. The gas pressure rises rapidly in the hole until the gas pressure causes the hard material to fracture. The impact breaker is then used to complete fracturing of the material and to remove the fractured material.

11 Claims, 8 Drawing Sheets

METHOD FOR CONTROLLED FRAGMENTATION OF HARD ROCK AND CONCRETE BY THE COMBINATION USE OF IMPACT HAMMERS AND SMALL CHARGE BLASTING

The present application claims priority from copending U.S. Provisional application Ser. No. 60/001,956 entitled "METHOD FOR CONTROLLED FRAGMENTATION OF HARD ROCK AND CONCRETE BY THE COMBINATION USE OF IMPACT HAMMERS AND SMALL CHARGE BLASTING", filed Aug. 7, 1995, which is incorporated herein by reference in its entirety.

FIELD OF THE INVENTION

The present invention relates generally to a method for excavating hard rock and concrete and, specifically, to a method for excavation of hard rock and concrete using small charge blasting and impact hammers.

BACKGROUND OF THE INVENTION

The excavation of rock is a primary activity in the mining, quarrying and civil construction industries. There are a number of important unmet needs of these industries relating to the excavation of rock and other hard materials.

These include:

Reduced Cost of Rock Excavation

Increased Rates of Excavation

Improved Safety and Reduced Costs of Safety

Better Control Over the Precision of the Excavation Process

Cost Effective Method of Excavation Acceptable in Urban and Environmentally Sensitive Areas Drill & blast methods are the most commonly employed and most generally applicable means of rock excavation. These methods are not suitable for many urban environments because of regulatory restrictions. In production mining, drill and blast methods are fundamentally limited in production rates while in mine development and civil tunneling, drill and blast methods are fundamentally limited in advance rates because of the cyclical nature of the large-scale drill & blast process.

Tunnel boring machines are used for excavations requiring long, relatively straight tunnels with circular cross-sections. These machines are rarely used in mining operations.

Roadheader machines are used in mining and construction applications but are limited to moderately hard, non-abrasive rock formations.

Mechanical impact breakers are currently used as a means of breaking oversize rock, concrete and reinforced concrete structures. Mechanical impact breaker technology has advanced by increasing the blow energy and blow frequency of the impact tool through the use of high-energy hydraulic systems; and through the use of high-strength, high-fracture-toughness steels for the tool bit. Mechanical impact breakers can be used in almost any workplace setting because of the absence of air-blast and their relatively low seismic signature. As a general excavation tool, mechanical impact breakers are limited to relatively weak rock formations having a high degree of fracturing. In harder rock formations (unconfined compressive strengths above 60 to 80 MPa), the excavation effectiveness of mechanical impact breakers drops quickly and tool bit wear increases rapidly. Mechanical impact breakers cannot, by themselves, excavate an underground face in massive hard rock formations economically.

Small-charge blasting techniques can be used in all rock formations including massive, hard rock formations. Small-charge blasting includes methods where small amounts of blasting agents are consumed at any one time, as opposed to episodic conventional drill and blast operations which involve drilling multiple hole patterns, loading holes with explosive charges, blasting by millisecond timing the blast of each individual hole and in which tens to thousands of kilograms of blasting agent are used.

Small-charge blasting may produce flyrock which is unacceptable to nearby machinery and structures and may generate unacceptable air-blast and noise. In addition, small-charge blasting techniques cannot economically be used to excavate with the precision often required.

There is thus a need for a method and means to break rock efficiently and with low-velocity fly-rock such that drilling, mucking, haulage and ground support equipment can remain at the working face during rock breaking operations.

SUMMARY OF THE INVENTION

These and other needs are addressed by the present invention. In one embodiment, the present invention provides a method for controlled fragmentation of a hard material that includes the steps:

(a) releasing gas into the bottom of a hole located in a free surface of the hard material;

(b) sealing the gas in the bottom of the hole to pressurize the hole bottom and cause a fracture to propagate from the bottom of the hole, thereby forming a fractured portion of the hard material a portion of which is exposed in the free surface surrounding the hole; and (c) impacting the fractured portion exposed at the free surface with an impact breaker to remove the material in the fractured portion from the free surface. The amount of blasting agent used to form the gas is typically relatively small. The fracture is an existing fracture that intercepts the hole bottom, the pressurized region of the hole, or a new fracture propagated from a bottom corner of the hole.

The method provides a number of advantages. The combination of small-charge blasting and an impact breaking techniques significantly increases the rock-breaking efficiency of both techniques compared to their respective efficiencies when used separately. The joint use of small-charge blasting and impact breaking techniques typically permits a greater volume of rock to be removed over a shorter time period than is otherwise possible with the separate use of small-charge blasting and impact breaking techniques especially in harder materials. The combination of the two techniques further offers the advantages of small-charge blasting (e.g., the use of a low seismic signature and low amount of fly rock during blasting), with the advantages of impact breaking techniques (e.g., the ability to trim the contour the excavation face and comminute large pieces of rock at the face to enhance the mucking operation).

The gas can be released into the bottom of the hole by detonation of an explosive or combustion of a propellant. Small-charge blasting techniques may involve shooting holes individually or shooting several holes simultaneously. The seismic signature of small-charge blasting methods is relatively low because of the small amount of blasting agent used at any one time. Underground small-charge blasting techniques involve removal of typically on the order of about 0.3 to about 10 bank cubic meters per shot using from about 0.15 to about 0.5 kilograms of blasting agent, depending on the method used. In surface excavations, small-charge and surface small-charge blasting techniques, the size of the charge and amount of rock broken per shot may be increased to about 1 to about 3 kilograms blasting agent to remove about 10 to about 100 bank cubic meters of rock per shot. The impact breaker preferably impacts the fractured portion of the free surface with a blow energy ranging from about 0.5 to about 500 kilojoules. The blow frequency of the impact breaker typically ranges from about 1 blow per second to about 200 blows per second.

The impacting step preferably directly follows the releasing and sealing steps. The techniques can be sequentially employed on a hole-by-hole basis or for multiple holes at one time.

DETAILED DESCRIPTION OF THE PREFERRED EMBODIMENT

Figure 1:
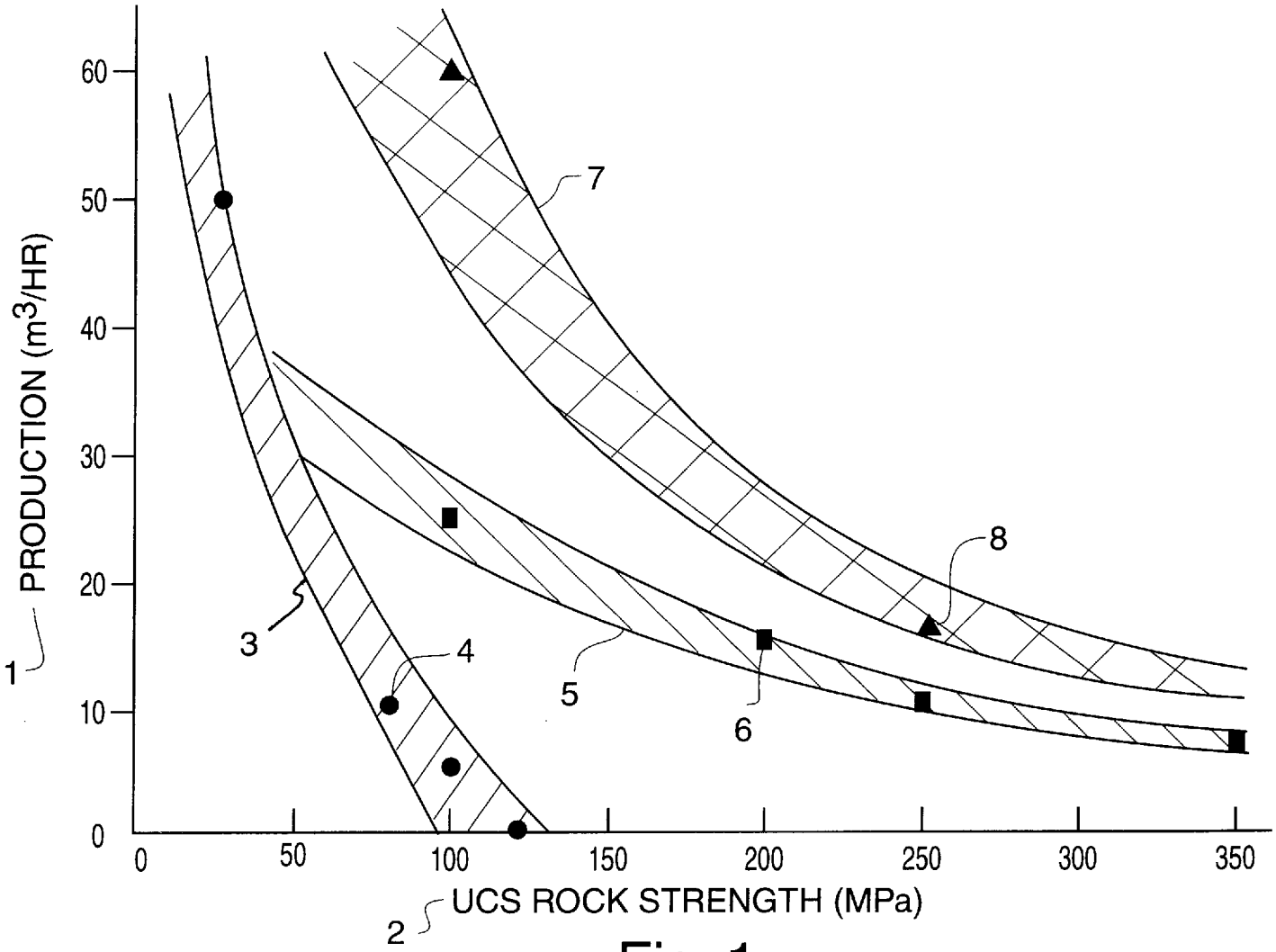
FIG. 1 is a graph showing the production rates of (1) a typical mechanical breaker, (2) a typical small-charge blasting process and (3) the combination of the two methods as a function of unconfined compressive rock strength. This graph illustrates how the performance of the combination of the two methods is greater than the sum of the two individually.

The present invention is based on the combination usage of a small-charge blasting process and a mechanical impact breaker (also known as a hydraulic hammer or impact ripper). A small charge blasting method implies that the rock is broken out in small amounts using small amounts of explosives, as opposed to episodic conventional drill and blast operations which involve drilling multiple hole patterns, loading holes with explosive charges (e.g., in amounts ranging from about 20 to about 250 tons in surface excavations), blasting by millisecond timing of the blast of each individual hole, ventilating and mucking cycles. In underground excavations, small-charge blasting techniques preferably use an amount of blasting agent ranging from about 0.15 to about 0.5, more preferably from about 0.15 to about 0.3, and most preferably from about 0.15 to about 0.2 kilograms to remove an amount of material ranging from about 0.3 to about 10, more preferably from about 1 to about 10, and most preferably from about 3 to about 10 bank cubic meters. In surface excavations, small-charge blasting techniques use an amount of blasting agent preferably ranging from about 1 to about 3, more preferably from about 1 to about 2.5, and most preferably from about 1 to about 2 kilograms to remove an amount of material ranging from about 10 to about 100, more preferably from about 15 to about 100, and most preferably from about 20 to about 100 bank cubic meters. "Bank cubic meters" is the cubic meters of in-place rock, not the cubic meters of loose rock dislodged from the rock face.

Small-charge blasting usually involves shooting holes individually but can include shooting several holes simultaneously. The seismic signature of small-charge blasting methods is relatively low because of the small amount of blasting agent used at any one time. Preferred blasting agents include explosives and propellants.

It may be advantageous to drill and shoot multiple holes simultaneously (within a total period less than about 1 second), although the total amount of blasting agent used will be on the order of about 2 kilograms or less for small-charge blasting. However, most small charge blasting methods envisioned herein would usually be accomplished by drilling and shooting a short hole every several minutes. The average time between sequential small-charge blasting shots ranges preferably from about 0.5 minutes to about 10 minutes, more preferably from about 1 minute to about 6 minutes and most preferably from about 1 minute to about 3 minutes.

The small charge blasting technique can be modified to optimize the efficiency of the impact breaker by employing deeper drill holes than are normally employed for small charge blasting techniques. The deeper drill hole depth substantially minimizes flyrock energy by causing more of the fractured rock to remain in place in the face. In rock, the hole depth when small charge blasting techniques are combined with impact breaking techniques preferably ranges from about 3 to about 15 hole diameters. In one embodiment, a substantial amount of the fractured rock remains in place at the face. Typically, the charge imparts only enough energy to the rock to fracture the rock but not to cause the rock to be dislodged from the face. Preferably, at least about 50%, more preferably at least about 75%, and most preferably at least about 80% remains in place at the face.

The mechanical impact breaker operates by delivering a series of mechanical blows to the rock. The contact area of the breaker with the fractured rock preferably ranges from about 500 to about 20,000 square millimeters. Blow energies are in the range of several kilojoules and frequency of hammer blows is in the range of about 1 to about 100 blows per second. The mechanical impact breaker can also be used to wedge, pry and rip out rock which is fractured or partially dislodged. The mechanical impact breaker energy per blow shot ranges preferably from about 0.5 kilojoules to about 20 kilojoules, more preferably from about 1 kilojoule to about 15 kilojoules and most preferably from about 1 kilojoules to about 10 kilojoules. The mechanical impact breaker blow frequency ranges preferably from about 1 blow per second to about 100 blows per second, more preferably from about 5 blows per second to about 100 blows per second and most preferably from about 25 blows per second to about 100 blows per second.

The present invention involves breaking rock or other hard material such as concrete, by using a small-charge blasting method interactively with a mechanical impact breaker to achieve very efficient rock breakage; tight control of any flyrock associated with the small-charge blasting process; a low seismic signature; and precision control of the periphery of the excavation contour. The flyrock kinetic energy ranges preferably from about 0 to about 450 joules per kilogram, more preferably from about 0 to about 100 joules per kilogram and most preferably from 0 to about 50 joules per kilogram. The peak seismic particle velocity as measured at 10 meters from the shot point or impact point ranges preferably from about 0 to about 30 millimeters per second, more preferably from about 0 to about 15 millimeters per second and most preferably from about 0 to about 2 millimeters per second. Overbreak as measured from the intended excavation contour ranges preferably from about 0 to about 150 millimeters, more preferably from about 0 to about 100 millimeters and most preferably from about 0 to about 50 millimeters.

In both fractured and massive hard rock, the combination use of small-charge blasting and mechanical breakers can provide optimum performance. By way of example, a shot sometimes fails to completely break out the rock and a hydraulic breaker can effectively and quickly complete the rock breakage and removal. It is anticipated that in many applications an operator may tend to undershoot holes to minimize fly rock. Thus, the function of the breaker is to complete the breaking of the rock; to condition the broken rock into the desired fragmentation size; to trim the contour of the excavation to the specified dimension; and to remove small humps and toes.

In relatively weak fractured rock formations, the mechanical impact breaker can operate alone with reasonable efficiency (energy required to remove a unit volume of rock) and with acceptable lifetime for the breaker tool bit. The efficiency of the mechanical impact breaker can be improved by using one or several shots of a small-charge blasting process to fracture and weaken the rock. If desired, the central portion of the excavation can be completely removed by the small-charge blasting, creating additional free surfaces for the mechanical impact breaker. The drill hole required by the small-charge blasting process can be drilled deep enough to ensure that the rock is either fractured around the bottom of the drill hole without being dislodged, or the rock is dislodged with very low energy flyrock. In relatively weak fractured rock formations, the mechanical impact breaker will generally be used to excavate the bulk of the rock. For example, the small-charge blasting may remove on the order of about 20% of the rock while the mechanical impact breaker will remove the remaining 80%.

In moderately strong rock with some fracturing, both the excavation efficiency and tool bit life of the mechanical impact breaker decreases as a result of increased rock hardness, reduced fracturing and, often, loss of hetrogeneity of the rock formation. In this situation, the number of small-charge blasting drill holes is increased to weaken and/or remove a greater fraction of the excavation. The mechanical impact breaker is used to remove any remaining loosely bound rock in the central portion of the excavation, and is used to complete the excavation to the desired periphery or trim line of the excavation. Again, the drill hole required by the small-charge blasting process can be drilled deep enough to ensure that the rock is either fractured around the bottom of the drill hole without being dislodged, or the rock is dislodged with very low energy flyrock. In moderately strong rock with some fracturing, the small-charge blasting and the mechanical impact breaker will remove approximately equal amounts of the excavation.

In relatively hard to very hard, massive rock formations, the mechanical impact breaker cannot, by itself, fragment or remove any significant amounts of rock and tool bit life is substantially reduced or vanishes. In this case, small-charge blasting or some other means must be used to fragment the rock. Small-charge blasting is capable of excavating in hard, massive rock formations on its own, but its excavating efficiency is also substantially reduced. Relatively short holes must be drilled in the harder rock. If the hole is too deep, little or no rock may dislodged. If the hole is too short, the energy of the flyrock may be very high, resulting in damage to nearby equipment. However, if the drill holes for the small-charge blasting are drilled deeper rather than shallower, the occurrence of high-energy flyrock is nearly eliminated. After several small-charge shots, it has been found that a mechanical impact breaker can then dislodge large portions of rock. This is because the small-charge blasting shots have created a network of subsurface fractures in the regions around the bottom of the drill holes and have weakened the rock sufficiently for a mechanical impact breaker to regain efficiency with acceptable tool bit life. In hard, massive rock formations, many more small-charge blasting shots must be taken. The amount of impact hammering depends on how much rock is actually removed by the small-charge blasting. In addition to shooting the central portion of the excavation, small-charge shots must be made nearer the periphery of the excavation. The mechanical impact breaker, because of its superior control, is still used to provide the finished trim to the desired contour.

The key aspect of the combination use of small-charge blasting and the mechanical impact breaker is that the efficiency of using both is far greater than the efficiency of using either process by itself. The breaker, in effect enhances the average yields of the small-charge blasting process. The small-charge blasting enhances the efficiency and tool life of the mechanical impact breaker and extends its range of utility to the harder, less fractured rock formations.

For example, in rock having an Unconfined Compressive Strength (UCS) of about 60 to about 100 MPa, the mechanical breaker alone might be expected to require about 4 hours to remove about 30 cubic meters (at approximately 100 kW delivered to the rock face). A small-charge blasting process alone might require about 2 hours and about 20 shots to excavate about 30 cubic meters (at approximately 0.3 kilogram (1 megajoule) blasting agent per shot). When used together, the excavation of 30 cubic meters could be completed with 2 or 3 small-charge blasting shots which might take a ½ hour and a 1 hour of mechanical impact breaking.

At 75% utilization, the mechanical impact breaker alone would consume 18 MJ of energy and take 4 hours to complete the excavation. The small-charge blasting alone would consume 20 MJ and take 3 hours to complete the excavation (the breaker would have to be used to provide the final contour). The combination usage would consume about 7.5 MJ and complete the excavation in about 1½ hours.

As a further example, in rock having an Unconfined Compressive Strength (UCS) of about 250 to about 300

MPa, the mechanical breaker alone would be unable to break virtually any rock. A small-charge blasting process alone might require 5 hours and 60 shots to excavate 30 cubic meters. When used together, the excavation of 30 cubic meters could be completed with about 15 to about 25 small-charge blasting shots which might take a 2 hours and an additional 2 hours of mechanical impact breaking to dislodge rock not removed by the small-charge blasting, scale any loose rock and trim the contour of the excavation.

The small-charge blasting alone would consume about 60 MJ and take about 6 hours to complete the excavation (the breaker would have to be used to provide the final contour). The combination usage would consume from about 25 to about 35 MJ and complete the excavation in 4 hours.

The comparison of excavation production rates for mechanical impact breaker alone; small-charge blasting alone; and the combination usage of the two is shown in FIG. 1.

The present invention therefore represents a significant extension of mechanical impact breaker and small-charge blasting methods by combining the two methods in a way that substantially enhances the performance of each over the sum of their performances acting alone. The combination usage also compensates for significant limitations of each method acting alone.

By combining the two methods, productivity (as measured by cubic meters of rock fragmented per hour) is increased over the use of either method individually preferably by a factor of about 2 to about 10, more preferably by a factor of about 3 to about 10 and most preferably by a factor of about 4 to about 10.

By combining the two methods, the performance of the mechanical impact breaker is substantially improved in weak rock and extended into medium and hard rock formations where, acting alone, the mechanical impact breaker is incapable of economic excavation rates. By combining the two methods, tool bit wear of the mechanical impact breaker is significantly reduced and additional free surfaces are developed because the rock is weakened by the preceding small-charge blasting.

By combining the two methods, the average yield of the small-charge blasting shots is significantly enhanced, by factors of 2 to 10 because the mechanical impact breaker can dislodge fractured rock which blocks the effective placement of subsequent small-charge shots. By combining the two methods, the small-charge shot holes can be drilled deeper, thereby reducing or eliminating the energy of the flyrock from the small-charge shot.

Breakage Mechanism of Small-Charge Blasting

Figure 2:
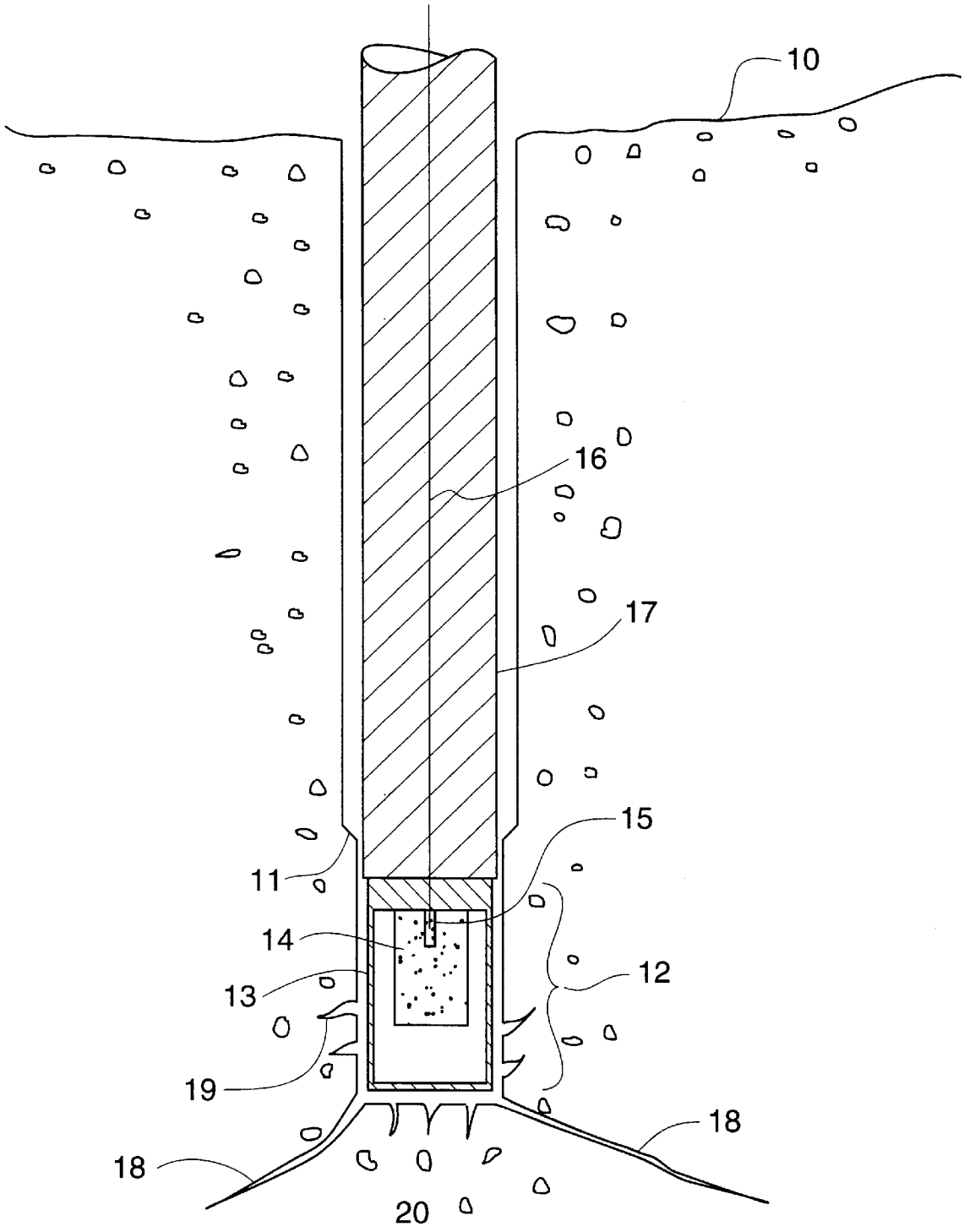
FIG. 2 is a cutaway side view of the general elements of a small-charge blasting process showing a short drill hole, a cartridge at the bottom of the hole containing an amount of blasting agent and a means of ignition, and a means of stemming (tamping, sealing) the charge to concentrate the gas products towards the bottom of the hole.

In small-charge blasting, a short hole is drilled in the rock, a small amount of blasting agent is placed in the hole, the charge is stemmed or tamped by a suitable material such as sand, mud, rock or by a steel bar, and the charge is initiated. The gas evolved by the charge can initiate and propagate new fractures or propagate existing fractures, thereby excavating a small volume of rock around the drill hole. The principal elements of a small-charge blasting process are shown in FIG. 2.

Figure 3:
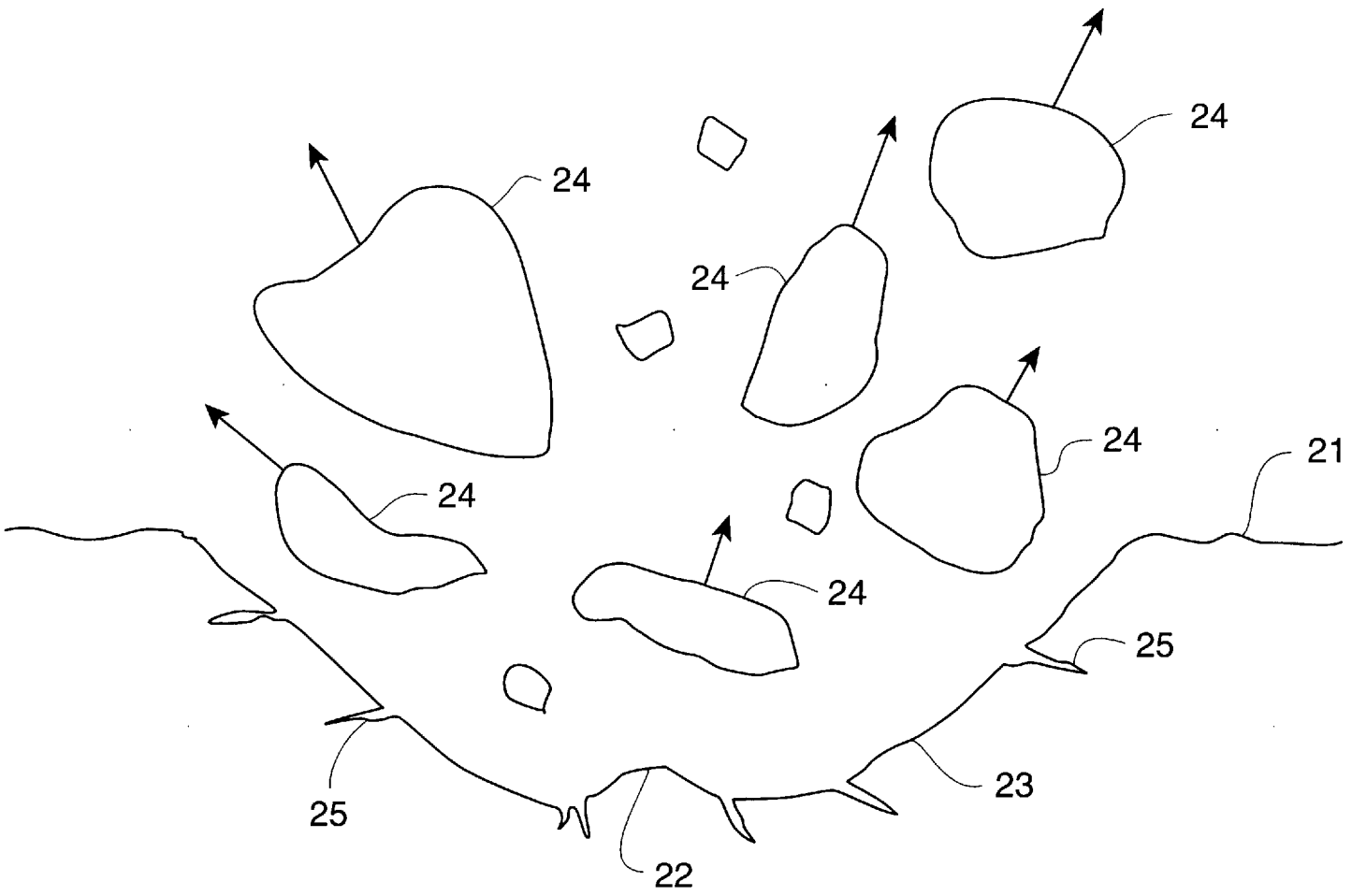
FIG. 3 is a cutaway side view of a crater formed in a rock face by a small-charge blasting process showing the fragmented rock being ejected from the crater and residual fractures remaining below the cratered region.

The drill hole may be drilled in such a way as to guarantee that fractures will be driven to completion and the broken rock will be accelerated away from the rock face with considerable energy such as illustrated in FIG. 3. In this case, the remaining rock will contain some residual fracturing around the excavated crater and the crater will constitute additional free surfaces. Both of these features will act to enhance the performance of a mechanical breaker.

Figure 4:
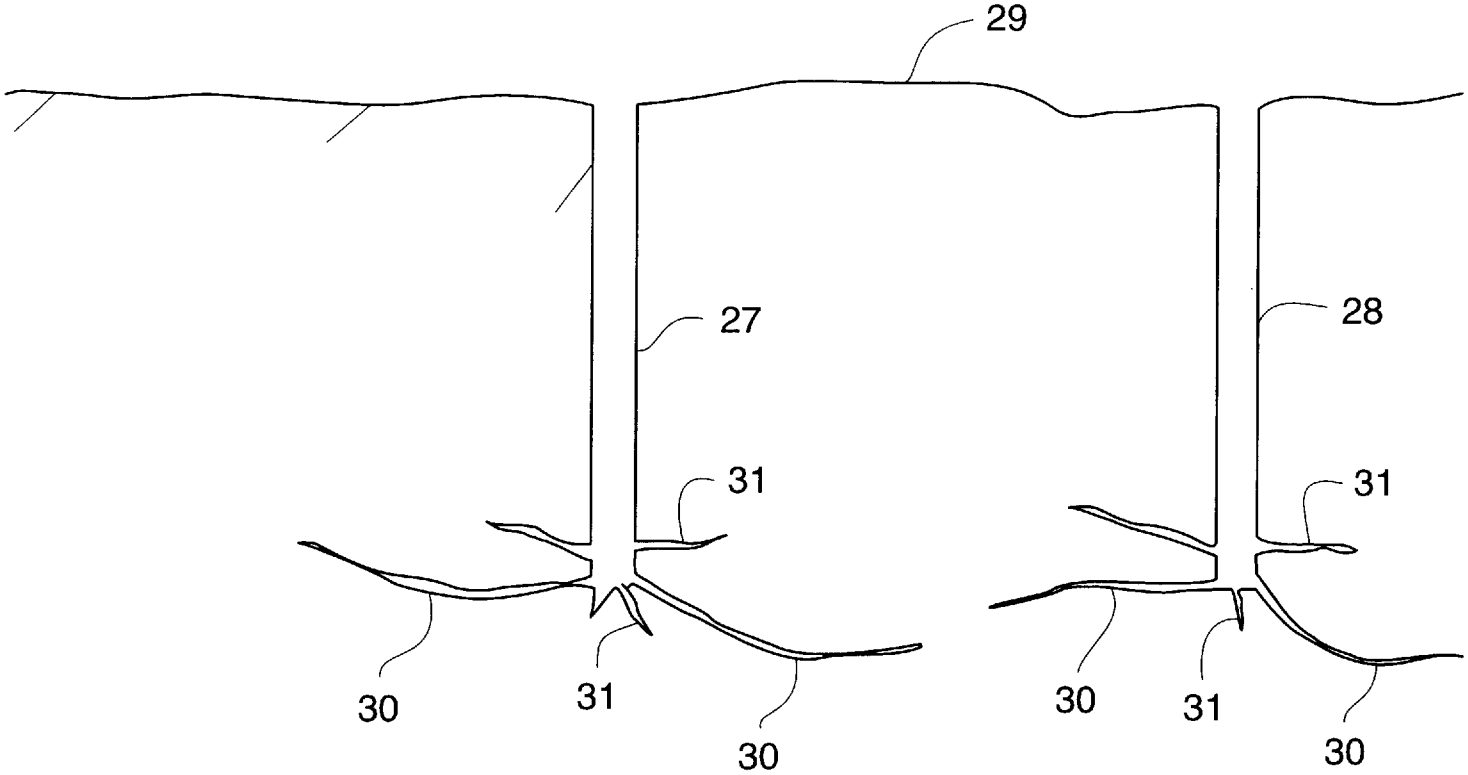
FIG. 4 is a cutaway side view of a rock face in which two short holes have been drilled and shot by a small-charge blasting process such that the rock surrounding the holes has not been removed. This schematic representation shows a large fracture or fractures driven into the rock near the bottom of the holes and other residual smaller fractures resulting from the small-charge blasting and illustrates how neighboring subsurface fracture networks can weaken the overall rock structure.

Alternately, the hole can be drilled deeper in such a way as to prevent fractures from being propagated to the surface or, if the fractures do reach the surface, there is little gas energy remaining to accelerate the fragments of broken rock. This situation is shown in FIG. 4. In this case the rock around the drill hole will have sustained a network of fractures which will considerably weaken the rock and act to enhance the performance of a mechanical breaker. Additionally, fractures that have propagated to the surface will be available for the mechanical impact breaker as locations where the rock can be pried, wedged or ripped loose.

The basic premise of small-charge blasting is the removal of small volumes of rock per shot by a series of sequential shots as opposed to episodic conventional drill and blast operations which involve drilling multiple hole patterns, loading holes with explosive charges, blasting by timing the blast of each individual hole, ventilating and mucking cycles. The amount of rock removed per shot in small-charge blasting is in the range of about ½ to about 3 cubic meters and the time interval between shots is typically 2 minutes or more.

There are several means of accomplishing small charge blasting. These include but are not limited to:

1. Drilling and shooting a short hole and using a conventional drill and blast techniques. The bottom portion of the hole can be loaded with an explosive charge and tamped by sand and/or rock. This is based on existing and well-known basic drill & blast practice.
2. Drilling and shooting a short hole employing cushion blasting techniques. Here the bottom portion of the hole can be loaded with an explosive charge which is decoupled from the rock and tamped by sand and/or rock. This is also based on existing and well-known basic drill & blast practice.
3. Using a gas-injector to pressurize the bottom of a short drill hole such as embodied in U.S. Pat. No. 5,098,163, Mar. 24, 1992, entitled "Controlled Fracture Method and Apparatus for Breaking Hard Compact Rock and Concrete Materials".
4. Using a propellant based Charge-in-the-Hole method to pressurize the bottom of a short drill hole such as embodied in U.S. Pat. No. 5,308,149, May 3, 1994, entitled "Non-Explosive Drill Hole Pressurization Method and Apparatus for Controlled Fragmentation of Hard Compact Rock and Concrete".
5. Using an explosive-based method to pressurize the bottom of a short drill hole such as embodied in Provisional U.S. patent application entitled "A Method and Apparatus for Controlled Small-Charge Blasting of Hard Rock and Concrete by Explosive Pressurization of the Bottom of a Drill Hole" and having Ser. No. 60/001,929.

The preferred method of small-charge blasting will be dependent on the type of rock formation and the best resultant fracturing patterns for achieving optimum performance by the mechanical breaker.

Breakage Mechanism of the Mechanical Impact Breaker

Figure 5:
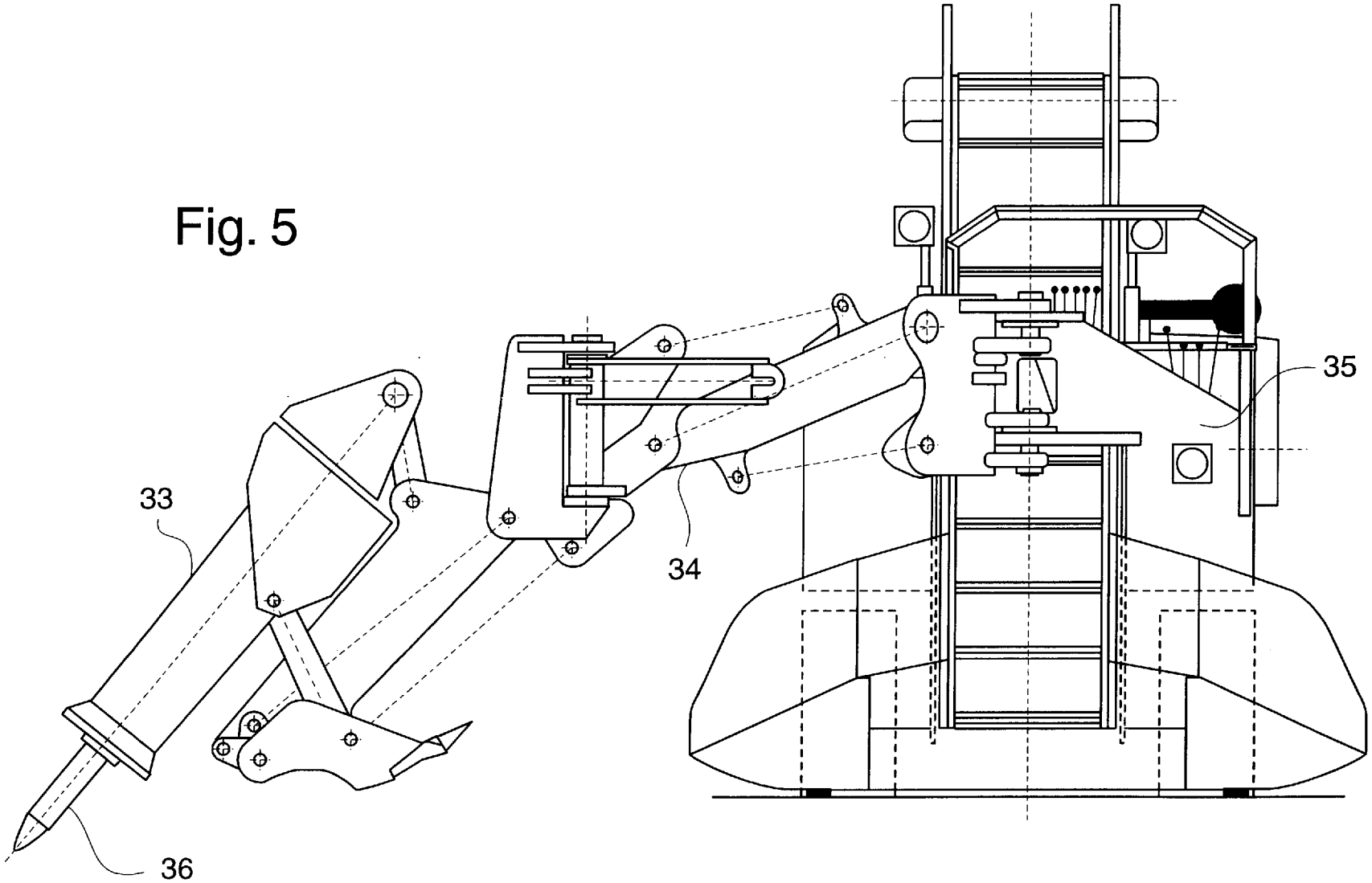
FIG. 5 is a cutaway side view of a typical mechanical impact breaker showing the breaker assembly and the breaker tool bit. The breaker assembly is shown mounted on an articulating boom assembly attached to an undercarrier.
Figure 6:
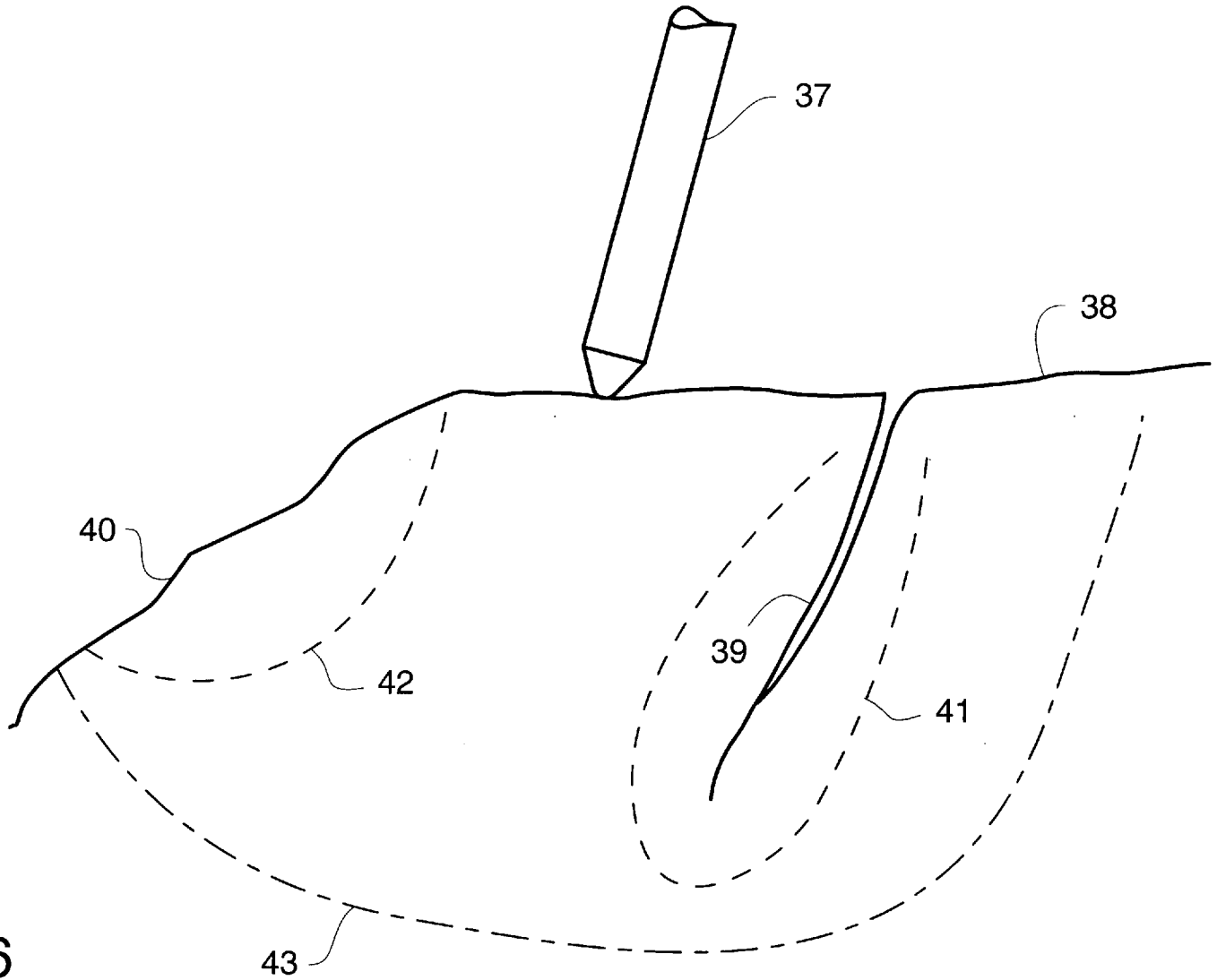
FIG. 6 is a cutaway side view of a rock face in which a mechanical impact breaker tool bit has impacted the rock face causing fractures to be initiated in the surrounding rock.

The mechanical impact breaker delivers a series of high energy blows to the rock face. A typical mechanical impact breaker is shown in FIG. 5. The energy of individual blows may be in the range of a few hundred joules to tens of kilojoules. The frequency of blows may be from a few blows per second to over a hundred blows per second. Each blow will propagate a shock spike into the rock which will reflect from a nearby free surface and place the rock in tension to create the conditions necessary for fracture initiation. Each blow may also extend existing fractures. A strong shock spike consists of a strong shock followed immediately by a sharp rarefaction wave such that the rise and fall of pressure occurs during a time that is short compared to the time required for a seismic wave to cross the volume of rock affected by the spike. These mechanisms are illustrated in FIG. 6. The series of blows may also set up vibrating stress patterns in the rock that can enhance breakage. The breaker tool bit may also be used to pry or wedge apart rock by forcing itself into partly opened fractures.

Breakage Mechanism of the Combination of Small-Charge Blasting and a Mechanical Impact Breaker One or more small charge shots may be fired into a rock face to create either (1) a network of subsurface fractures; (2) additional free surfaces; or (3) a combination of both. By developing fracture networks and additional free surfaces, the small charge blasting creates the conditions necessary for a mechanical impact breaker to become effective.

In many cases, the use of small-charge blasting alone results in several holes in which breakage is incomplete yet the rock around the hole bottom may be fractured. Subsequent holes will have to be placed far enough apart to avoid situations where the pressure developed in the subsequent hole bottom cannot vent prematurely into previously formed subsurface fractures, thereby reducing the yield of the shot. This situation can be reduced or eliminated by drilling shorter holes to ensure that the fractures reach the surface and the rock is entirely dislodged. However, this leads to situations where substantial amounts of gas energy may accelerate the fragmented rock to produce flyrock of sufficient energy to damage nearby equipment.

If the small-charge holes are drilled deep enough to fracture the rock around the hole bottom without dislodging the rock (equivalent to undershooting the hole), then a mechanical impact breaker can be used to dislodge the rock without danger of high energy flyrock. In this way, the rock face can be cleaned of loose rock and subsequent small-charge blasting shots can be placed into competent rock thereby reducing the possibility of prematurely venting the pressure developed in the hole bottom.

Thus the use of small-charge blasting extends the range of rock strengths in which the breaker can effectively operate. The breaker can help eliminate the loose rock that reduces the efficiency of small-charge blasting and help prevent the occurrence of high energy flyrock.

Components of the Combined System

Figure 7:
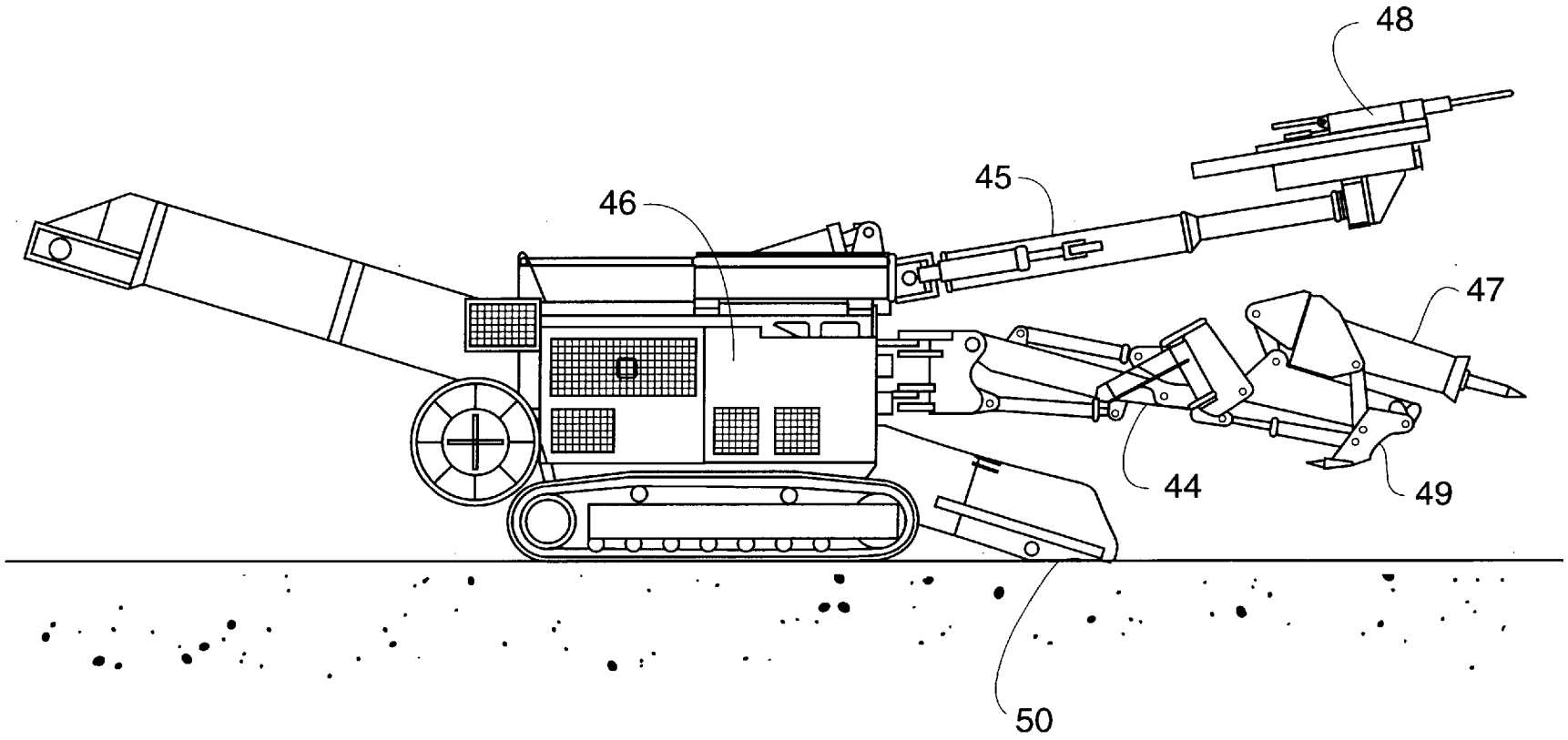
FIG. 7 is a cutaway side view of an excavation system showing the undercarrier, a boom on which a mechanical impact breaker is mounted, and a boom on which a small-charge blasting apparatus is mounted.

The basic components of the combination mechanical impact breaker/small-charge blasting system are:

the boom assembly and undercarrier the mechanical impact breaker the rock drill the small-charge blasting mechanism the indexing mechanism The basic components of the system are shown schematically in FIG. 7. The following paragraphs describe the envisioned characteristics of the various components.

The Boom Assembly and Undercarrier

The carrier may be any standard mining or construction carrier or any specially designed carrier for mounting the boom assembly or boom assemblies. Special carriers for shaft sinking, stope mining, narrow vein mining and military operations may be built.

Typically two boom assemblies are required. One is used to mount the mechanical impact breaker and the second is used to mount the small-charge blasting apparatus. The boom assemblies may be comprised of any standard mining or construction articulated boom or any modified or customized boom. The function of the boom assembly is to orient and locate the breaker or the small-charge apparatus to the desired location. In the case of the small-charge apparatus, the boom assembly may be used to mount an indexer assembly. The indexer holds both the rock drill and the small-charge mechanism and rotates about an axis aligned with both the rock drill and the small-charge mechanism. After the rock drill drills a short hole in the rock face, the indexer is rotated to align the small-charge mechanism for ready insertion into the drill hole. The indexer assembly removes the need for separate booms for the rock drill and the small-charge mechanism. The mass of the boom and indexer also serves to provide recoil mass and stability for the drill and small-charge mechanism.

The Mechanical Impact Breaker

The mechanical impact breaker is also known as a hydraulic hammer, high-energy hydraulic hammer or impact ripper. Initially, these mechanical impact breakers were pneumatically powered and used primarily for breaking down boulders and for concrete demolition work. Subsequently, hydraulic power was introduced and both blow energy and blow frequency were increased. As the power of mechanical impact breakers was increased, they were introduced into underground construction and mining operations, often being used in conjunction with a backhoe to excavate in soft, fractured rock. A form of mechanical impact breaker called the impact ripper has been developed in South Africa for stoping operations in narrow-reef mines. The mechanical impact breaker is typically mounted on its own boom assembly which is capable of orienting the breaker to the desired location and isolating the undercarrier form the vibrations generated during operation. Mechanical impact breakers may also incorporate feed back control to moderate the blow energy and frequency in response to varying rock conditions.

The Rock Drill

The drill consists of the drill motor, drill steel and drill bit, and the drill motor may be pneumatically or hydraulically powered.

The preferred drill type is a percussive drill because a percussive drill creates micro-fractures at the bottom of the drill hole which act as initiation points for bottom hole fracturing. Rotary, diamond or other mechanical drills may be used also.

Standard drill steels can be used and these can be shortened to meet the short hole requirements of the small-charge blasting process.

Standard mining or construction drill bits can be used to drill the holes. Percussive drill bits that enhance micro-fracturing may be developed. Drill hole sizes may range from 1-inch to 20-inches in diameter and depths are typically 3 to 15 hole diameters deep.

Drill bits to form a stepped hole for easier insertion of the small-charge mechanism may consist of a pilot bit with a slightly larger diameter reamer bit, which is a standard bit configuration offered by manufacturers of rock drill bits. Drill bits to form a tapered transition hole for easier insertion of the small-charge mechanism may consist of a pilot bit with a slightly larger diameter reamer bit. The reamer and pilot may be specially designed to provide a tapered transition from the larger reamed hole to the smaller pilot hole.

The Small-Charge Blasting Mechanism

The small-charge mechanism may consist of the following sub-systems:

1. cartridge magazine
2. cartridge loading mechanism
3. cartridge
4. cartridge ignition system
5. means of stemming (tamping) or sealing Cartridge Magazine—Propellant or explosive cartridges are stored in a magazine in the manner of an ammunition magazine for an autoloaded gun.

Cartridge Loading Mechanism—The loading mechanism is a standard mechanical device that retrieves a cartridge from the magazine and inserts it into the drill hole. The stemming bar described below may be used to provide some or all of this function.

The loading mechanism will have to cycle a cartridge from the magazine to the drill hole in no less than 10 seconds and more typically in 30 seconds or more. This is slow compared to modern high firing-rate gun autoloaders and therefore does not involve high-acceleration loads on the cartridge. Variants of military autoloading techniques or of industrial bottle and container handling systems may be used.

One variant is a pneumatic conveyance system in which the cartridge is propelled through a rigid or a flexible tube by pressure differences on the order of 1/10 bar.

Cartridge—The cartridge is the container for the blasting agent (explosive or propellant) and may be formed by a number of materials including wax paper, plastic, metal or a combination of the three. The function of the cartridge is to:

act as a storage container for the solid or liquid blasting agent to serve as a means of transporting the blasting agent from the storage magazine to the excavation site to protect the blasting agent charge during insertion into the drill hole if necessary, to serve as a combustion chamber for the blasting agent if necessary, to provide internal volume to control the pressures developed in the hole bottom to protect the blasting agent from water in a wet drill hole to provide the stemming bar with isolation from any strong shock transients from the blasting agent to provide a backup sealing mechanism for the blasting agent product gases as the blasting agent is consumed in the drill hole.

Cartridge Ignition System—In the case of a blasting agent comprised of an explosive, standard or novel explosive initiation techniques may be employed. These include instantaneous electric blasting caps fired by a direct current pulse or an inductively induced current pulse; non-electric blasting caps; thermalite; high-energy primers or an optical detonator, where a laser pulse initiates a light sensitive primer charge.

In the case of a blasting agent comprised of a propellant, standard or novel propellant initiation techniques may be employed. These include percussive primers where a mechanical hammer or firing pin detonates the primer charge; electrical primers where a capacitor discharge circuit provides a spark to detonate the primer charge; thermal primers where a battery or capacitor discharge heats a glow wire; or an optical primer where a laser pulse initiates a light sensitive primer charge.

Means of Stemming (Tamping) or Sealing—In the small-charge blasting methods envisioned herein, the blasting agent will be placed in the bottom of a short drill hole and the top portion of the drill hole will be stemmed (tamped) or sealed by any of several means depending on the small-charge method used. The function of the stemming means is to inertially contain the high-pressure gases evolved from the blasting agent in the bottom of the hole for a sufficient period (typically a few hundred microseconds to a few milliseconds) to cause fracturing of the rock.

In the case of drilling and shooting a short hole and using a conventional drill and blast techniques, the bottom portion of the hole can be loaded with an explosive charge and tamped by sand and/or rock or by an inertial stemming bar such as described below.

In the case of drilling and shooting a short hole employing cushion blasting techniques, the bottom portion of the hole can be loaded with an explosive charge which is decoupled from the rock and tamped by sand and/or rock or by an inertial stemming bar such as described below.

In the cases of a gas-injector (U.S. Pat. No. 5,098,163), or the propellant based Charge-in-the-Hole method (U.S. Pat. No. 5,308,149), or the explosive based method (Provisional U.S. patent application entitled "A Method and Apparatus for Controlled Small-Charge Blasting of Hard Rock and Concrete by Explosive Pressurization of the Bottom of a Drill Hole"), the primary method by which the high gas-pressures are contained at the hole bottom until the rock is fractured, is by the massive inertial stemming bar which blocks the flow of gas up the drill hole except for a small leak path between the stemming bar and the drill hole walls. This small leakage can be further reduced by design features of the cartridge containing the blasting agent and of the stemming bar. The stemming bar can be made from a high-strength steel or from other materials that combine high density and mass for inertia, strength to withstand the pressure loads without deformation and toughness for durability.

The Indexing Mechanism—The rock drill and small-charge blasting mechanism are mounted on an indexing unit which in turn is mounted on a separate boom from the mechanical impact breaker. The function of the indexing mechanism is to allow the drill hole to be formed and then to allow the small-charge mechanism to be readily aligned and inserted to the drill hole. A typical indexer mechanism is illustrated in FIG. 8. The indexer is attached to its boom by means of hydraulic couplers that allow the indexer to be positioned at the desired angles and distance from the rock face. The indexer is first positioned so that the rock drill can drill a short hole into the rock face. The indexer is then rotated about an axis common to the drill and the small-charge mechanism so that the small-charge mechanism becomes aligned with the drill hole. The small-charge mechanism is then inserted into the hole and is ready to be fired.

Applications

This method of breaking soft, medium and hard rock as well as concrete has many applications in the mining, construction and rock quarrying industries and military operations. These include:

tunneling cavern excavation shaft-sinking adit and drift development in mining long wall mining room and pillar mining stoping methods (shrinkage, cut & fill and narrow-vein)

selective mining undercut development for vertical crater retreat (VCR) mining draw-point development for block caving and shrinkage stoping secondary breakage and reduction of oversize trenching raise-boring rock cuts precision blasting demolition open pit bench cleanup open pit bench blasting boulder breaking and benching in rock quarries construction of fighting positions and personnel shelters in rock reduction of natural and man-made obstacles to military movement The estimated production rate 1, expressed as bank cubic meters per hour, of rock excavated is shown as a function of unconfined compressive strength of the rock 2, expressed in megapascals (MPa) in FIG. 1. The performance of a typical mechanical impact breaker is shown as a hatched region 3 and illustrates that the mechanical impact breaker does not excavate rock with an unconfined compressive strength above about 150 MPa. Published data points 4 are shown in the hatched region 3. The performance of a typical small-charge blasting process is shown as a hatched region 5 and illustrates that small-charge blasting can excavate rock throughout the range of unconfined compressive strengths typical of the rock excavation industry. Published data points 6 are shown in the hatched region 5. The performance of a combination small-charge blasting process and mechanical impact breaker working interactively is shown as a cross-hatched region 7 and illustrates that the combination usage excavates more effectively than the sum of the two methods acting separately. Experimentally determined data points 8 are shown in the cross-hatched region 7.

The elements of a small-charge blasting system are shown in FIG. 2. A short hole 9 is drilled into the rock face 10 by a rock drill. The drill hole 9 may have a stepped diameter change 11 which can be accomplished by a reamer/pilot drill bit combination. The stepped diameter 11 can serve the purpose of limiting the maximum travel of the cartridge insertion means or may be used to assist in sealing the gases evolved in the hole bottom 12. A cartridge 13 is placed in the hole bottom 12. The cartridge 13 contains a charge of blasting agent 14. Combustion of the blasting agent 14 is initiated by an ignition means 15 which is controlled remotely through an electrical or optical communication line 16 which passes through the stemming bar 17. The stemming bar 17 is used to inertially confine the high-pressure gases evolved in the hole bottom 12 upon ignition of the blasting agent 14. The stemming bar 17 may also provide a sealing function to prevent the escape of high-pressure gases from the hole bottom 12 during the period required to develop primary fractures 18 and residual fractures 19 in the rock 20 surrounding the hole bottom 12.

FIG. 3 illustrates the overall rock fragmentation process for a small-charge blasting shot in which a relatively short hole has been drilled and the hole has been "overshot". A hole has been drilled into the rock face 21. The bottom of the drill hole 22 may appear at the center of the bottom of the excavated crater 23. Fragmented rock 24 has been energetically ejected from the crater under the accelerating action of the gases generated by the blasting agent. Residual fractures 25 remain in the rock 26 below the crater walls.

FIG. 4 illustrates the overall rock fragmentation process for a small-charge blasting shot in which a relatively deep hole has been drilled and the hole has been "undershot". Holes 27 and 28 have been drilled into the rock face 29. The rock has not been dislodged by the small-charge shots but primary fractures 30 and residual fractures 31 have been created in the rock 32. These form a subsurface network of fractures that have weakened the overall rock structure. This rock will be easier to break out, either by subsequent small-charge shots or by a mechanical impact breaker.

A typical modern mechanical impact breaker is shown in FIG. 5. The mechanical impact breaker housing 33 is attached to an articulated boom assembly 34, which is in turn attached to an undercarrier 35. The tool bit 36 is powered by a hydraulic piston mechanism within the breaker housing 33. The undercarrier 35 moves the breaker 33 within range of the working face and the boom 34 positions the breaker 33 so that the tool bit 36 can operate on the rock face.

FIG. 6 illustrates the basic breakage mechanism of a mechanical impact breaker. The tool bit 37 is shown at the moment of impact on a rock face 38. The rock face 38 contains a pre-existing fracture 39. To the left of the rock face, is a nearby free surface 40. The shock spike generated by the impact of the tool bit 37 radiates out and reflects as a tensile wave from the surface of the pre-existing fracture 39 creating a region of rock in tension 41 in which additional fracturing will be initiated. The shock spike also radiates out and reflects as a tensile wave from the free surface 40 creating a second region of rock in tension 42 in which additional fracturing will be initiated. After repeated impact blows by the tool bit 37, the fractures initiated in regions 41 and 42 will link up and dislodge the rock mass represented by region 43.

A rock excavation system based on the combination use of a small-charge blasting system and a mechanical impact breaker is shown in FIG. 7. There are two articulating boom assemblies 44 and 45 attached to a mobile undercarrier 46. The boom assembly 44 has a mechanical impact breaker 47 mounted on it. The boom assembly 45 has a small-charge blasting apparatus 48 mounted on it. Shown as optional equipment on the excavator are a backhoe attachment 49 for moving broken rock from the workface to a conveyor system 50 which passes the broken rock through the excavator to a haulage system (not shown).

Figure 8A:
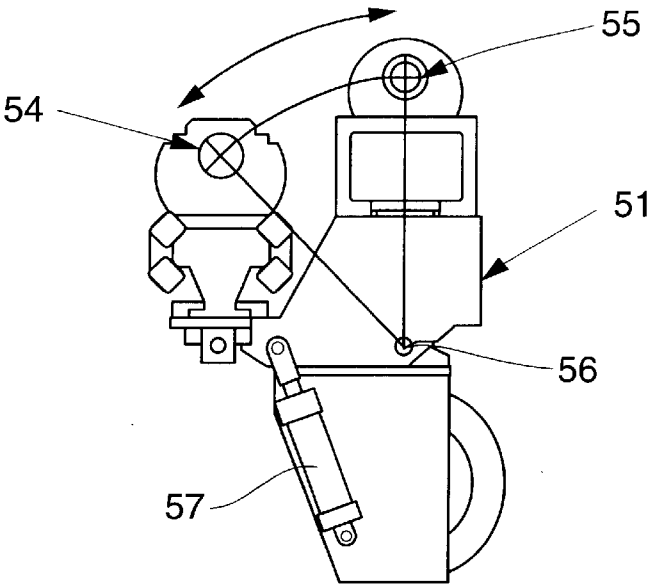
FIGS. 8A and B is (1) a cutaway side view of a small-charge blasting apparatus mounted on an indexing mechanism which is in turn mounted on the end of an articulating boom assembly and (2) a head-on view of the indexing mechanism showing a rock drill and a small-charge blasting apparatus.
Figure 8B:
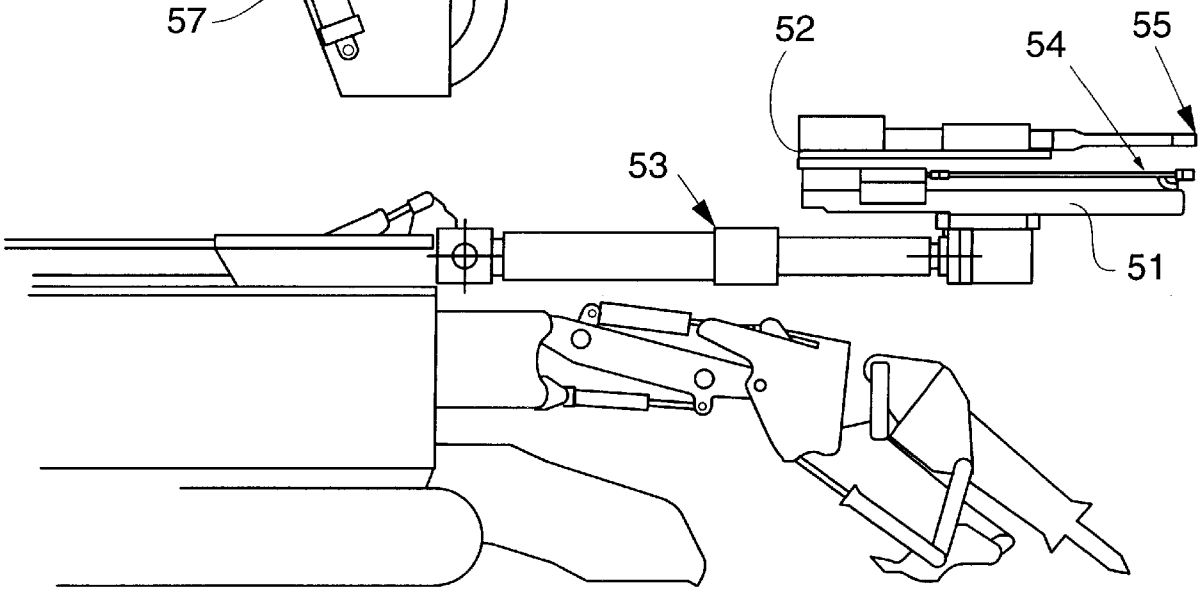

A typical indexing mechanism for the small-charge blasting apparatus is shown in FIGS. 8A and B. The indexing mechanism 51 connects the small-charge blasting apparatus 52 to the articulating boom 53. A rock drill 54 and a small-charge insertion mechanism 55 are mounted on the indexer 51. The boom 53 positions the indexer assembly at the rock face so that the rock drill 54 can drill a short hole (not shown) into the rock face (also not shown). When the rock drill 54 is withdrawn from the hole, the indexer 51 is rotated about its axis 56 by a hydraulic mechanism 57 so as to align the small-charge insertion mechanism 55 with the axis of the drill hole. The small-charge insertion mechanism 55 is then inserted into the drill hole and the small-charge is ready for ignition.

While various embodiments to the present invention have been described in detail, it is apparent that modifications and adaptations of those embodiments will occur to those skilled in the art. However, it is to be expressly understood that such modifications and adaptations are within the spirit and scope of the present invention of the following claims.

What is claimed is:

1. A method for controlled fragmentation of a hard material, comprising:

(a) releasing gas in the bottom of a hole located in a free surface of the hard material;

(b) sealing the gas in the bottom of the hole to pressurize the hole bottom and cause a fracture to propagate from the bottom of the hole, thereby forming a fractured portion of the hard material a portion of which is exposed in the free surface surrounding the hole; and (c) impacting the fractured portion exposed at the free surface with an impact breaker to remove the material in the fractured portion from the free surface.

2. The method of claim 1, wherein the hole has a diameter and a depth from the free surface ranging from about 3 to about 15 hole diameters.

3. The method of claim 1, wherein the fractured portion has a volume and in underground excavations the volume ranges from about 0.3 to about 10 bank cubic meters and in surface excavations the volume ranges from about 10 to about 100 bank cubic meters.

4. The method of claim 1, wherein the gas is formed by at least one of an explosive and propellant and the amount of the one of the explosive and propellant ranges from about 0.15 to about 0.5 kilograms in underground excavations and from about 1 to about 3 kilograms in surface excavations.

5. The method of claim 1, wherein the impact breaker impacts the fractured portion with a blow energy ranging from about 0.5 to about 500 kilojoules.

6. The method of claim 1, further comprising:

(d) repeating step (c) as needed to remove the fractured portion from the free surface.

7. The method of claim 1, wherein the blow frequency of the impact breaker ranges from about 1 blow per second to about 200 blows per second.

8. A method for controlled fragmentation of a hard material, comprising:

(a) releasing gas into the bottom of a hole located in a free surface of the hard material;

(b) sealing the gas in the bottom of the hole to pressurize the hole bottom and cause a fracture to propagate from the bottom of the hole, thereby forming a fractured portion of the hard material in the free surface surrounding the hole; and (c) impacting the fractured portion exposed at the free surface with a blunt object to remove the material in the fractured portion from the free surface, wherein the blunt object contacts the free surface with a blow energy of at least about 0.5 kilojoules and a blow frequency of at least about 1 blow per second.

9. The method of claim 8, wherein the contact area of the blunt object with the fractured portion ranges from about 500 to about 20,000 $mm^2$.

10. A method for controlled fragmentation of a hard material, comprising:

(a) releasing gas into the bottom of a hole located in a free surface of the hard material;

(b) sealing the gas in the bottom of the hole to pressurize the hole bottom and cause a fracture to propagate from the bottom of the hole, thereby forming a fractured portion of the hard material in the free surface surrounding the hole; and (c) impacting the fractured portion exposed at the free surface with a mechanical impact breaker to remove the material in the fractured portion from the free surface, wherein the mechanical impact breaker contacts the free surface with a blow energy of at least about 0.5 kilojoules.

11. The method of claim 10, wherein the blow frequency is at least about 1 blow per second.

* * * * *